US010555659B2

(12) United States Patent
Himmelsbach et al.

(10) Patent No.: US 10,555,659 B2
(45) Date of Patent: Feb. 11, 2020

(54) CONVEYOR DISHWASHER HAVING A SENSOR DEVICE FOR DETECTING THE CONCENTRATION OF DISINFECTANT

(71) Applicants: Björn Himmelsbach, Offenburg (DE); Frank Zoller, Offenburg-Elgersweier (DE); Harald Disch, Elzach (DE); Klaus Padtberg, Offenburg (DE)

(72) Inventors: Björn Himmelsbach, Offenburg (DE); Frank Zoller, Offenburg-Elgersweier (DE); Harald Disch, Elzach (DE); Klaus Padtberg, Offenburg (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 301 days.

(21) Appl. No.: 15/123,253

(22) PCT Filed: Mar. 3, 2015

(86) PCT No.: PCT/US2015/018376
§ 371 (c)(1),
(2) Date: Sep. 2, 2016

(87) PCT Pub. No.: WO2015/134415
PCT Pub. Date: Sep. 11, 2015

(65) Prior Publication Data

US 2017/0065146 A1 Mar. 9, 2017

(30) Foreign Application Priority Data

Mar. 6, 2014 (DE) ..... 10 2014 102 970

(51) Int. Cl.
*A47L 15/24* (2006.01)
*A47L 15/00* (2006.01)

(52) U.S. Cl.
CPC ..... *A47L 15/241* (2013.01); *A47L 15/0036* (2013.01); *A47L 2401/023* (2013.01); *A47L 2501/26* (2013.01); *A47L 2501/32* (2013.01)

(58) Field of Classification Search
CPC ..... A47L 15/241
See application file for complete search history.

(56) References Cited

U.S. PATENT DOCUMENTS 4,228,813 A 10/1980 Noren
5,500,050 A * 3/1996 Chan et al. ..... 134/18
(Continued)

FOREIGN PATENT DOCUMENTS

CN 101146474 3/2008
CN 101711661 5/2010
(Continued)

OTHER PUBLICATIONS

EP 2228000, Dirschus et al., Sep. 2010, English machine translation.*

(Continued)

*Primary Examiner* — Jason Y Ko
(74) *Attorney, Agent, or Firm* — Thompson Hine LLP

(57) ABSTRACT

The present invention relates to a conveyor dishwasher—with at least one final rinse zone with at least one final rinse nozzle for spraying final rinse liquid onto washware, and wherein a metering device associated with the final rinse zone is provided for adding a disinfectant to the final rinse liquid in a metered manner. A sensor device is configured to detect the concentration of disinfectant in the final rinse liquid which is sprayed in the final rinse zone. Furthermore, a control device is configured to compare the value of the concentration of disinfectant which is detected by the sensor device with predefinable concentration values and, in the event of excessively high deviations of the concentration of (Continued)

disinfectant from the predefinable concentration values, to interrupt the dishwashing process or to output a warning signal to an operator.

17 Claims, 1 Drawing Sheet

(56) References Cited

U.S. PATENT DOCUMENTS

| | | | | |
|---|---|---|---|---|
| 9,078,553 | B2 | 7/2015 | Peukert et al. | |
| 2010/0071725 | A1 | 3/2010 | Peukert et al. | |
| 2012/0298146 | A1* | 11/2012 | Padtberg et al. | 134/25.2 |
| 2013/0061403 | A1* | 3/2013 | BringeWatt et al. | 8/137 |
| 2014/0034088 | A1 | 2/2014 | Padtberg et al. | |
| 2014/0342020 | A1* | 11/2014 | Forstmeier | C02F 1/686 424/661 |
| 2015/0272420 | A1 | 10/2015 | Peukert et al. | |

FOREIGN PATENT DOCUMENTS

| | | | |
|---|---|---|---|
| CN | 101918634 | | 12/2010 |
| DE | 10 2008 048 491 | A1 | 4/2010 |
| DE | 102009012566 | | 9/2010 |
| DE | 10 2009 024 569 | A1 | 4/2011 |
| EP | 2228000 | A2 | 9/2010 |
| WO | 2010/144307 | A1 | 12/2010 |

OTHER PUBLICATIONS

PCT, International Search Report and the Written Opinion of the International Searching Authority, 10 pages, dated May 15, 2015.
HACH LANGE: Intelligente amperometrische Sensoren für freies Chlor, Cl02 and O3. Düsseldorf, pp. 1-4, Firmenschrift (2005).
Schleicher, Jürgen, Amperometrische Messung von freiem Chlor, Chlordioxid and Ozon. In: Analysenmesstechnik in flüssen Medien, (Hg.) Brandt, Ö. [at al], Fulda: JUMO GmbH, pp. 181-220—Firmenschrift (2012).
PCT, International Search Report and Written Opinion, International Application No. PCT/US2015/018376; dated Sep. 15, 2016, 7 pages.

* cited by examiner

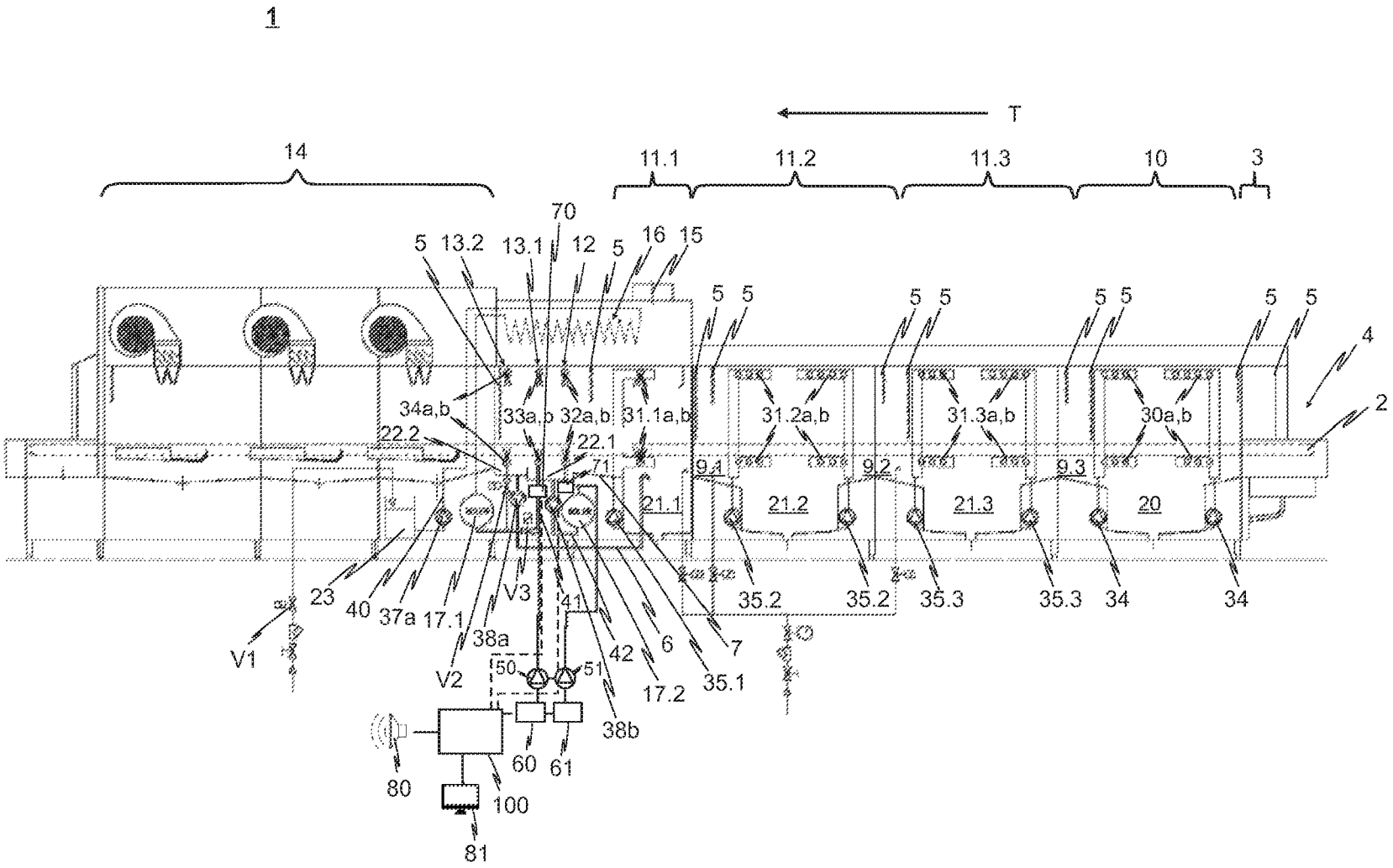
1
2
3
4
5
6
7
10
11.1
11.2
11.3
12
13.1
13.2
14
15
16
17.1
17.2
20
21.1
21.2
21.3
22.1
22.2
23
30a,b
31.1a,b
31.2a,b
31.3a,b
32a,b
33a,b
34
34a,b
35.1
35.2
35.3
37a
38a
38b
40
41
42
50
51
60
61
70
80
81
100
9.1
9.2
9.3
9.4
V1
V2
V3
T

CONVEYOR DISHWASHER HAVING A SENSOR DEVICE FOR DETECTING THE CONCENTRATION OF DISINFECTANT

CROSS-REFERENCE TO RELATED APPLICATIONS

This application is a National Stage filing of International Application No. PCT/US2015/018376 filed Mar. 3, 2015, which claims priority of German Patent Application No. 10 2014 102 970.4 filed Mar. 6, 2014, which are incorporated herein by reference in their entireties.

The invention relates to a conveyor dishwasher for washing washware.

More specifically, the invention relates to a conveyor dishwasher for washing washware, which conveyor dishwasher has at least one wash zone with at least one wash nozzle for spraying wash liquid onto the washware, and has at least one final rinse zone with at least one final rinse nozzle for spraying final rinse liquid onto the washware. Furthermore, a metering device is associated with the final rinse zone, which a metering device is provided for adding a disinfectant to the final rinse liquid in a metered manner.

Conveyor dishwashers (conveyor warewashers) are used in the commercial sector. In contrast to domestic dishwashers, in which the washware to be cleaned remains stationary in the machine during cleaning, in conveyor dishwashers the washware is conveyed through various treatment zones of the machine.

In the case of conveyor dishwashers, the washware, for example dishes, pots, glasses, flatware and other articles which are to be cleaned, is conveyed through a plurality of treatment zones, for example pre-wash zone(s), main-wash zone(s), post-wash or pre-rinse zone(s), final rinse zone(s) and drying zone(s). A conveyor apparatus which generally has compartments for accommodating washware is used to convey washware in a conveying direction through the conveyor dishwasher. In the case of a flight-type dishwasher, the compartments can be formed by supporting fingers on a conveyor belt of the conveyor apparatus. In the case of rack-conveyor dishwashers, dish racks in which compartments can be formed in order to accommodate the washware to be treated serve as the conveyor apparatus. It is feasible here for the dish racks to be conveyed through the rack-conveyor dishwasher by a conveying device.

In the field of commercial dish-cleaning by means of conveyor dishwashers, special requirements in respect of the hygiene performance of cleaning processes have to be taken into consideration. In order to meet the requirements defined in the corresponding (national) standards and guidelines, the washware, after passing through the wash zone(s) of the conveyor dishwasher, is often then disinfected with the aid of a thermal-chemical process in conventional conveyor dishwashers.

Instead of thermal-chemical post-treatment, it is also known to carry out purely chemical disinfection on the washware in a low-temperature process, during which disinfection the temperature of the liquid (wash liquid, final rinse liquid) which is sprayed into the respective treatment zones in the conveyor dishwasher is intentionally not increased for disinfection purposes. In order to nevertheless be able to effectively disinfect the washware, a chemical disinfection process is used, in which a liquid to which a chemical disinfectant is admixed is sprayed onto the washware.

In order to achieve a satisfactory hygiene state of the washware after said washware has been treated in the conveyor dishwasher, the chemical disinfection has to be performed in the final rinse zone. The contact time between the washware and a disinfection solution should be, in principle, at least 7 seconds. The minimum concentration of the disinfectant in the disinfection solution which comes into contact with the washware depends on the type of disinfection chemical used. When using sodium hypochlorite (NaOCl), for example, it is necessary to use a minimum concentration of 50 ppm.

The problem with conventional conveyor dishwashers which operate with a low-temperature rinsing method is that of protecting and monitoring the disinfection line. By way of example, U.S. Pat. No. 4,228,813 B discloses a conveyor dishwasher in which a disinfectant is added in the final rinse zone in a metered manner. The percentage of the quantity of disinfectant added in a metered manner is constantly kept at a high level in the process, so that it is possible to guarantee that any existing germs and bacteria have been reliably eliminated. However, this results in increased consumption of cleaning chemicals which represent a high cost factor and secondly harm the environment. In addition, the excessive use of chemical disinfectants may result in traces, for example streaks and/or traces of odor, of the disinfection chemical remaining on the washware. These remaining traces of disinfection chemical can be easily identified on vulnerable washware in particular, for example drinking glasses and flatware, and therefore often lead to operators or customers rejecting the low-temperature process in spite of the large potential savings in comparison to thermal processes in which the washware is disinfected by increasing the temperature of the liquid (wash liquid and/or final rinse liquid) which is sprayed during the washware treatment.

Based on the above-mentioned problem, the object of the present invention is to develop a conveyor dishwasher of the kind cited in the introductory part in such a way that an optimum final rinse result can be achieved while at the same time reducing the consumption, in particular of disinfection chemical and energy, wherein it is guaranteed that the required hygiene standard can be complied with.

Accordingly, the conveyor dishwasher according to the invention is distinguished in that a sensor device is provided, this sensor device being configured to detect the concentration of disinfectant in the final rinse liquid which is sprayed in the final rinse zone. Furthermore, a control device is provided according to the invention, this control device being configured to compare the concentration of disinfectant which is detected by the sensor device with one or more predefinable (or predefined) concentration values. Finally, it is provided according to the invention, in the event of excessively high deviations of the concentration of disinfectant from the predefinable concentration values, to interrupt the dishwashing process or to output a warning signal to an operator.

The advantages of the conveyor dishwasher according to the invention are obvious: for example, the sensor device immediately identifies when the concentration of disinfectant in the final rinse zone does not correspond to the prespecified concentration values. Accordingly, the sensor device can ensure that problems in the disinfection action can be promptly identified. If the concentration of disinfectant reaches a critical value, the washing process can be interrupted by the control device or a warning signal can be output to an operator. Consequently, incorrect concentrations in the disinfection chemicals of the freshwater final rinse system can be identified before an inadequate disinfection action occurs. The control device re-enables the dishwashing process or terminates the output of a warning signal only after the concentration of disinfectant again reaches a level at which it is ensured that germs and bacteria are reliably eliminated.

Advantageous developments of the conveyor dishwasher according to the invention can be found in the dependent claims.

For example, in a first embodiment, it is provided that the control device is designed in such a way that the maximum permissible deviations of the concentration of disinfectant from the predefinable concentration values can be adjusted. In other words, the operator of the conveyor dishwasher according to the invention can change the tolerance limits of the concentration of disinfectant at the control device according to this aspect. For example, at a concentration of disinfectant of 70 ppm, it could be defined that the permissible deviation is 20 ppm, that is to say that the control device interrupts the dishwashing process or outputs a warning signal as soon as the value of the concentration of disinfectant either falls below the minimum concentration of 50 ppm or exceeds a maximum concentration of 90 ppm.

In this connection, it is particularly advantageous when the control device is configured to use a first definable value for the permissible deviation when the value of the concentration of disinfectant which is measured by the sensor device is greater than the predefined concentration value, wherein a second definable value is used for the permissible deviation when the value of the concentration of disinfectant which is measured by the sensor device is less than the predefined concentration value. It is therefore feasible, for example, for only a deviation of 10 ppm to be permissible as soon as the value of the concentration of disinfectant is below the defined concentration value. In contrast, a higher deviation may be acceptable (for example 40 ppm) when the value of the concentration of disinfectant is greater than the defined concentration value. The reason for this is, in particular, that the situation of the concentration value falling below the defined concentration value rapidly leads to an inadequate disinfection action and therefore to germs and bacteria remaining. In comparison to this, an excessive concentration is less harmful since this does not present any hazard to the health of humans.

According to a further embodiment, the conveyor dishwasher according to the invention has a conveyor apparatus, in particular a conveyor belt, for conveying washware through the at least one wash zone and the at least one final rinse zone. In this case, the control device is configured to stop the conveyor apparatus as soon as the maximum permissible deviations of the concentration of disinfectant from the definable concentration values are exceeded. Stopping the conveyor belt prevents inadequately disinfected washware from leaving the conveyor dishwasher. Instead, this washware remains within the conveyor dishwasher until the required concentration values are reached again. In principle, it is also feasible for the conveyor belt to be stopped only when the concentration falls below the required minimum concentration, while further operation of the conveyor belt does not present a hazard when the maximum concentration is exceeded. In other words, this means that the actions of the control device can be individually adjusted by the operator. In particular, different actions can be defined for the inadequate concentration and, respectively, the excess concentration.

As an alternative or in addition to the abovementioned embodiment, the control device can further be configured to interrupt the spraying of wash liquid and/or final rinse liquid as soon as the maximum permissible deviations of the concentration of disinfectant from the definable concentration values are exceeded. It goes without saying that this effectively prevents wash liquid and/or final rinse liquid being unnecessarily applied to the washware for as long as there is an excess concentration or inadequate concentration of the disinfectant.

Finally, as an alternative or in addition to the abovementioned actions, the control device can be configured to output an optical or acoustic warning signal as soon as the maximum permissible deviations of the concentration of disinfectant are exceeded. For this purpose, the control device can be connected, for example, to a loudspeaker or to a screen in order to inform the operator about the deficient concentration of disinfectant. In this case, the warning signals can be output, in particular, directly to the conveyor dishwasher or else to a central control system via "remote control". It is also feasible for the warnings to be transmitted to the user directly on the mobile radio device of said user.

According to a further realization, the control device can be configured, in particular, to output causes for the deviations of the concentration of disinfectant from the definable concentration values together with the optical and acoustic warning signals. Possible causes for the concentration falling below the minimum concentration are, for example, a change in the disinfection chemical (change in manufacturer or packaging), the lack of disinfectant, increased throughflow of fresh water (dishwashing arm is missing, dishwashing arm is not exactly in position) or a defect in the metering pump or the metering hoses. However, excess concentrations can then likewise occur due to a change in the disinfection chemical and also due to a reduced throughflow of fresh water (for example due to blocked nozzles). By virtue of outputting the causes, the operator can respond to the faulty concentration of disinfectant particularly quickly, as a result of which downtimes of the conveyor dishwasher according to the invention can be minimized.

According to a further aspect, the control device is configured, in particular, in such a way that the dishwashing process is interrupted or a warning signal is output to an operator as soon as a concentration of disinfectant falls below 50 ppm and/or as soon as a concentration of disinfectant rises above 100 ppm. By virtue of adjusting the control device in this way, it is ensured that the currently applicable standards and/or guidelines in which the requirements in respect of the hygiene performance of cleaning processes are defined are complied with. However, it should be noted that the minimum concentration of disinfectant is dependent on the type of disinfection chemical used.

The above-mentioned minimum concentration of 50 ppm should be achieved, in particular, in the case of chlorine solutions such as sodium hypochlorite. In general, a chlorine solution, in particular sodium hypochlorite (NaOCl) or else hypochlorous acid (HOCl), is preferably used. In this case, the disinfection chemical is only metered into the final rinse zone which is used for disinfection.

Since disinfectant based on a chlorine solution is preferably used, it is provided according to a further embodiment that the sensor device is designed to detect free chlorine radicals. In this case, the sensor device can be designed, in particular, in such a way that free chlorine radicals in a concentration range of between 0 and 200 ppm are detected, wherein a measurement resolution of ±10 ppm, preferably ±5 ppm, and particularly preferably of ±3 ppm is achieved. It goes without saying that the tolerance limits for the concentration of disinfectant should be selected in such a way that an adequate disinfection action can also continue to be achieved even with a measurement error of up to 10 ppm.

According to a further embodiment of the conveyor dishwasher according to the invention, the sensor device is designed to detect the concentration of disinfectant continuously or at predefinable time intervals. As an alternative to this, it is of course also feasible for the concentration of disinfectant to be detected as a consequence of certain events, for example when the disinfectant is changed or at the discretion of the operator.

According to a further aspect, the conveyor dishwasher further has a final rinse liquid line which is connected or can be connected to the final rinse nozzles. In this case, the sensor device is designed to measure the concentration of disinfectant directly in, or by means of a branch of, the final rinse liquid line. Accordingly, it is ensured that the concentration of disinfectant in the final rinse liquid is already detected by the sensor device before contact is made with the washware. Therefore, it is possible to react to an impermissible change in concentration of disinfectant in good time.

In order to achieve as high a degree of energy efficiency as possible, the temperatures of the wash liquid are below 60 degrees, preferably below 45 degrees, in the conveyor dishwasher according to the invention. The dishwashing temperature of the final rinse zone in which final rinse liquid with a metered disinfection chemical is sprayed, is higher than the wash liquid temperature, wherein the final rinse temperature is below 80° C., preferably below 75° C.

The dishwashing result can be yet further improved when the conveyor dishwasher further has at least one pre-rinse zone with at least one pre-rinse nozzle, which pre-rinse zone is arranged upstream of the final rinse zone. The pre-rinse zone has, in particular, a metering device which is provided for adding a disinfectant to the pre-rinse liquid in a metered manner. According to the invention, the concentration of disinfectant in the pre-rinse zone can also be monitored by a sensor device, that is to say the pre-rinse liquid which is sprayed in the pre-rinse zone is monitored by a further sensor.

In order to further reduce the consumption of water by the conveyor dishwasher according to the invention, it is advantageous to reuse at least a portion of the final rinse liquid which is sprayed in the final rinse zone as pre-rinse liquid in the pre-rinse zone. To this end, the pre-rinse zone can have a pre-rinse tank which is fitted below the final rinse zone and serves to collect the final rinse liquid which is sprayed in the final rinse zone and to supply said final rinse liquid to the pre-rinse nozzles of the pre-rinse zone using a pumping apparatus.

In the text which follows, the invention will be described in greater detail with reference to the exemplary embodiment of the conveyor dishwasher according to the invention illustrated in the drawing, in which:

FIG. 1: shows a schematic side view of a conveyor dishwasher according to a first embodiment of the invention.

FIG. 1 shows a schematic side view of a conveyor dishwasher 1 according to a first embodiment of the invention having a conveyor apparatus 2 for conveying washware, not illustrated, in a conveying direction T through the conveyor dishwasher 1. The conveyor dishwasher 1 has at least one wash zone, as illustrated in FIG. 1 for example, a pre-wash zone 10 and three main-wash zones 11.1, 11.2, 11.3 which are arranged downstream of the pre-wash zone 10 as seen in the conveying direction T.

As seen in the conveying direction T, a post-wash zone or pre-rinse zone 12 is arranged downstream of the at least one wash zone 10, 11.1, 11.2, 11.3, and at least one final rinse zone, for example only a first final rinse zone 13.1 as illustrated, in which final rinse liquid containing a metered disinfection chemical is sprayed onto the washware, and a second additional final rinse zone or post-disinfection final rinse zone 13.2, in which fresh water without a metered disinfection chemical is sprayed onto the washware continuously or as required, are arranged downstream of the post-wash zone or pre-rinse zone 12. In the conveyor dishwasher 1 illustrated in FIG. 1, the additional final rinse zone or post-disinfection final rinse zone 13.2 is followed by a drying zone 14 as seen in the conveying direction T of the washware.

The respective zones 10, 11.1, 11.2, 11.3, 12, 13.1, 13.2 and 14 of the conveyor dishwasher 1 can be separated from one another by means of separating curtains 5. In the embodiment illustrated in FIG. 1, the inlet tunnel 3 of the conveyor dishwasher 1 itself is also separated from the machine inlet 4 by a separating curtain 5. The provision of the separating curtains 5 prevents wash liquid and final rinse liquid spraying between zones and prevents vapors escaping from the conveyor dishwasher 1.

Said treatment zones 10, 11.1, 11.2, 11.3, 12, 13.1 and 13.2 of the conveyor dishwasher 1 have associated spray nozzles 30*a*, 30*b*, 31.1*a*, 31.1*b*, 31.2*a*, 31.2*b*, 31.3*a*, 31.3*b*, 32*a*, 32*b*, 33*a*, 33*b*, 34*a* and 34*b*. These spray nozzles 30*a*, 30*b*, 31.1*a*, 31.1*b*, 31.2*a*, 31.2*b*, 31.3*a*, 31.3*b*, 32*a*, 32*b*, 33*a*, 33*b*, 34*a* and 34*b* serve to spray liquid onto the washware to be treated as said washware is conveyed through the respective treatment zones 10, 11.1, 11.2, 11.3, 12, 13.1 and 13.2 by the conveyor apparatus 2. The individual spray systems of the treatment zones 10, 11.1, 11.2, 11.3, 12, 13.1 and 13.2 ensure that the washware to be treated is sprayed down both from the top and from the bottom. It would also be feasible to additionally further provide lateral spray nozzles.

The main-wash zones 11.1, 11.2, 11.3 and the pre-wash zone 10 further have associated tanks (main-wash tanks 21.1, 21.2, 21.3, pre-wash tank 20) for accommodating sprayed liquid and/or for providing liquid for the spray nozzles 30*a*, 30*b*, 31.1*a*, 31.1*b*, 31.2*a*, 31.2*b*, 31.3*a* and 31.3*b* of the relevant treatment zones 10, 11.1, 11.2, 11.3 and 12.

The additional final rinse zone or post-disinfection final rinse zone 13.2 has an associated collection device 22.2 for collecting liquid which is sprayed in the additional final rinse zone 13.2. As illustrated, the collection device 22.2 which is associated with the additional final rinse zone 13.2 can be in the form of a tank or in the form of a collection container, wherein the intention is for this collection device 22.2 to be arranged with respect to the spray nozzles (final rinse nozzles) 34*a*, 34*b* which are associated with the additional final rinse zone 13.2 in such a way that the liquid which is sprayed in the additional final rinse zone 13.2 flows into the collection device 22.2 due to the force of gravity and is collected there.

In the illustrated embodiment, the final rinse zone 13.1 which is arranged upstream of the additional final rinse zone or post-disinfection final rinse zone 13.2 likewise has an associated collection device—in this case in the form of a tank—which is denoted by the reference numeral 22.1 in FIG. 1. Said collection device 22.1 which is associated with the final rinse zone 13.1 is formed separately from the collection device 22.2 which is associated with the additional final rinse zone 13.2 and therefore serves to collect the liquid which is sprayed in the final rinse zone 13.1. The liquid which is collected in the collection device 22.1 which is associated with the final rinse zone 13.1 is supplied to the spray nozzles 32*a*, 32*b* which are associated with the pre-rinse zone 12 with the aid of a pump (pre-rinse pump 38*b*).

In the conveyor dishwasher 1 which is illustrated in FIG. 1, final rinse liquid, which is made up of fresh water with a rinse aid which may be added in a metered manner and is of equal quality to drinking water in microbiological terms, is sprayed in the additional final rinse zone or post-disinfection final rinse zone 13.2 onto the washware, not illustrated, by means of the final rinse nozzles 34*a*, 34*b* which are arranged above and below the conveyor apparatus 2 and optionally also to the sides of said conveyor apparatus. The final rinse liquid which is sprayed in the additional final rinse zone or post-disinfection final rinse zone 13.2 is collected in the collection device 22.2 which is associated with the additional final rinse zone or post-disinfection final rinse zone 13.2 and, in particular, does not enter the final rinse zone 13.1 which is arranged upstream of the additional final rinse zone or post-disinfection final rinse zone 13.2.

In the final rinse zone 13.1 however, final rinse liquid, which is made up of fresh water with metered disinfection chemical and possibly metered rinse aid, is sprayed onto the washware, not illustrated, by means of the final rinse nozzles 33*a*, 33*b* which are arranged above and below the conveyor apparatus 2 and optionally also to the sides of said conveyor apparatus. The liquid which is sprayed in the final rinse zone 13.1 is collected in the collection device 22.1 which is associated with the final rinse zone 13.1 and is then supplied to the pre-rinse nozzles 32*a*, 32*b* of the pre-rinse zone 12 with the aid of the pre-rinse pump 38*b*. Wash liquid is rinsed off from the washware in the pre-rinse zone 12. The liquid (pre-rinse liquid) which is sprayed onto the washware, not illustrated, by the pre-rinse nozzles 32*a*, 32*b* in the pre-rinse zone 12 is conveyed from treatment zone to treatment zone by means of a cascade system in the opposite direction to the conveying direction T of the washware. However, it would also be feasible here for only a portion of the liquid which is sprayed in the pre-rinse zone 12 to be conveyed by means of the cascade system in the opposite direction to the conveying direction T, while the remaining portion of the pre-rinse liquid which is sprayed in the pre-rinse zone 12 is conducted directly into the pre-wash tank 20, which is associated with the pre-wash zone 10, via a valve (not illustrated) and a bypass line (not illustrated).

In the cascade system, the pre-rinse liquid which is sprayed by the pre-rinse nozzles 32*a*, 32*b* flows from the pre-rinse zone 12 into the main-wash tank 21.1 which is associated with the (main-) wash zone 11.1 due to the force of gravity. The pre-rinse liquid which is sprayed in the pre-rinse zone 12 and collected by the main-wash tank 21.1 is then delivered to the spray nozzles of the (main-) wash zone 11.1 (upper and lower main-wash nozzles 31.1*a*, 31.1*b*) with the aid of a main-wash pump 35.1.

In the conveyor dishwasher 1 which is illustrated in the drawings, the final rinse zone 13.1 and the additional final rinse zone 13.2 are supplied with fresh water, wherein the fresh water supply is divided. A disinfection chemical, for example NaOCl, is metered via a metering pump 50 in the final rinse liquid line 41 into a first portion of the fresh water which is supplied to the conveyor dishwasher 1. It goes without saying that other disinfection chemicals, for example chlorine dioxide (ClO2) or sodium hypochloride (NaOCl) or hypochlorous acid (HClO) can also be added in a metered manner depending on requirements. The fresh water to which the disinfection chemical is admixed serves, in the final rinse zone 13.1, as a final rinse liquid with a disinfection action which is discharged by means of the final rinse nozzles 33*a* and 33*b* which are associated with the final rinse zone 13.1.

A disinfection chemical is deliberately not admixed with the second portion of the fresh water which is supplied to the conveyor dishwasher 1 since this portion serves for post-disinfection final rinsing in the additional final rinse zone 13.2 and is sprayed by means of the final rinse nozzles 34*a* and 34*b* which are associated with the additional final rinse zone 13.2.

In the embodiment which is illustrated in FIG. 1, the temperature of the liquid which is sprayed in the additional final rinse zone 13.2 is at least substantially identical to the temperature of the liquid which is sprayed in the final rinse zone 13.1. The quantity of final rinse liquid which is introduced into the final rinse zone 13.1 per unit time can be adjusted via a valve V3.

In the embodiment which is illustrated in FIG. 1, the liquid which is collected in the collection device 22.2 of the post-disinfection final rinse zone or additional final rinse zone 13.2 is supplied cyclically to the last main-wash zone 11.1 which immediately adjoins the pre-rinse zone 12, and in particular to the main-wash tank 21.1 which is associated with the main-wash zone 11.1, by means of a liquid transfer system comprising a pump 38*a* and a bypass line 6. However, as an alternative to this, it would be also feasible for the liquid which is collected in the collection device 22.2 to be pumped out of the collection device 22.2, which is in the form of a tank, in a manner controlled with respect to time or level.

The final rinse liquid into which the disinfection chemical has been metered is collected in the collection device 22.1, which is likewise in the form of a tank, after being sprayed by means of the final rinse nozzles 33*a* and 33*b* which are associated with the final rinse zone 13.1, and then serves as a pre-rinse liquid in the pre-rinse zone 12. To this end, a pump 38*b* is provided, this pump pumping the liquid which is sprayed in the final rinse zone 13.1 and collected in the collection device 22.1 out of the collection device 22.1 which is in the form of a tank, and supplying said liquid to the pre-rinse nozzles 32*a* and 32*b* via a pre-rinse liquid line 42.

In the embodiment which is illustrated in FIG. 1, provision is made for it to be possible for the disinfection chemical (here: NaOCl) to be metered both into the final rinse liquid which is to be sprayed in the final rinse zone 13.1 and also into the pre-rinse liquid which is to be sprayed in the pre-rinse zone 12. To this end, a first metering device (metering pump 50), which is associated with the final rinse zone 13.1, and a second metering device (metering pump 51), which is formed and can be actuated independently of said first metering device, are provided, wherein the second metering device (metering pump 51) is associated with the pre-rinse zone 12. Specifically, the first metering pump 50 is connected or can be connected to the final rinse line 41 for this purpose, whereas the second metering pump 51 is connected or can be connected to the pre-rinse line 42.

In both cases, the corresponding metering device (metering pump 50, 51) is adjusted or actuated in such a way that the final rinse liquid which is sprayed in the final rinse zone 13.1 and the pre-rinse liquid which is sprayed in the pre-rinse zone 12 have a predefinable or predefined minimum concentration of disinfection chemical which depends on the type of metered disinfection chemical. To this end, the metering devices (metering pumps 50, 51) are connected or can be connected firstly to the control device 100 and secondly to the disinfectant containers 60, 61. As already indicated, a minimum concentration of 50 ppm is required when sodium hypochlorite (NaOCl) is used as the disinfection chemical.

Wash liquid is rinsed off from the washware in the pre-rinse zone 12. The liquid produced in the process flows into the main-wash tank 21.1, which is associated with the first main-wash zone 11.1, due to the force of gravity. A discharge element 7, for example a discharge base or a baffle plate, which conducts the pre-rinse liquid which is sprayed by the pre-rinse nozzles 32*a*, 32*b* into the main-wash tank 21.1 is preferably provided for this purpose. According to another embodiment, not illustrated, of the conveyor dishwasher 1, the discharge element 7 can be dispensed with if the main-wash tank 21.1 extends as far as beneath the pre-rinse nozzles 32*a*, 32*b* of the pre-rinse zone 12.

The liquid which is accommodated in the main-wash tank 21.1 of the first main-wash zone 11.1 is usually provided with a detergent and sprayed onto the washware by means of the spray nozzles of the first main-wash zone 11.1 (upper and lower main-wash nozzles 31.1*a*, 31.1*b*) with the aid of a first main-wash pump 35.1. The wash liquid which is sprayed by the main-wash nozzles 31.1*a*, 31.1*b* then flows back into the main-wash tank 21.1 due to the force of gravity.

The main-wash tank 21.1 is fluidically connected to the main-wash tank 21.2 which is associated with the second main-wash zone 11.2 via an overflow 9.1. The wash liquid which is sprayed in the first main-wash zone 11.1 enters the main-wash tank 21.2 of the second main-wash zone 11.2 via this overflow 9.1 when there is a sufficient quantity of wash liquid in the main-wash tank 21.1 of the first main-wash zone 11.1.

The liquid which is accommodated in the main-wash tank 21.2 of the second main-wash zone 11.2 is sprayed onto the washware by means of the spray nozzles of the second main-wash zone 11.2 (upper and lower main-wash nozzles 31.2*a*, 31.2*b*) with the aid of second main-wash pumps 35.2. The wash liquid which is sprayed by the main-wash nozzles 31.2*a*, 31.2*b* then flows back into the main-wash tank 21.2 of the second main-wash zone 11.2 due to the force of gravity.

The main-wash tank 21.2 of the second main-wash zone 11.2 is fluidically connected to the pre-wash tank 20 which is associated with the pre-wash zone 10 via an overflow line 9.2. The wash liquid which is sprayed in the second main-wash zone 11.2 enters the main-wash tank 21.3 via this overflow line 9.2 when there is a sufficient quantity of wash liquid in the main-wash tank 21.2 of the second main-wash zone 11.2.

The liquid which is accommodated in the main-wash tank 21.3 of the third main-wash zone 11.3 is sprayed onto the washware by means of the spray nozzles of the third main-wash zone 11.3 (upper and lower main-wash nozzles 31.3*a*, 31.3*b*) with the aid of third main-wash pumps 35.3. The wash liquid which is sprayed by the main-wash nozzles 31.3*a*, 31.3*b* then flows back into the main-wash tank 21.3 of the third main-wash zone 11.3 due to the force of gravity.

The main-wash tank 21.3 of the third main-wash zone 11.3 is fluidically connected to the pre-wash tank 20 which is associated with the pre-wash zone 10 via an overflow line 9.3. The wash liquid which is sprayed in the third main-wash zone 11.3 enters the pre-wash tank 20 via this overflow line 9.3 when there is a sufficient quantity of wash liquid in the main-wash tank 21.3 of the third main-wash zone 11.3.

The liquid which is accommodated in the pre-wash tank 20 of the pre-wash zone 10 is then sprayed onto the washware by means of the spray nozzles of the pre-wash zone 10 (upper and lower pre-wash nozzles 30*a*, 30*b*) with the aid of pre-wash pumps 34 in order to remove coarse particles of dirt from the washware. The wash liquid which is sprayed by the pre-wash nozzles 30*a*, 30*b* then flows back into the pre-wash tank 20 due to the force of gravity.

As already indicated, the liquid which is sprayed in the main-wash zones 11.1, 11.2 and 11.3 in the pre-wash zone 10 preferably contains detergent which is added in a metered fashion with the aid of a detergent metering apparatus (not shown in the drawings), for example, to the liquid which is accommodated in the main-wash tank 21.1 of the first main-wash zone 11.1.

The additional final rinse zone or post-disinfection final rinse zone 13.2 is followed by the abovementioned drying zone 14 in the conveying direction T. In the drying zone 14, the washware is dried using dry and heated air in order to blow off and/or dry up the moisture on the washware. In order to keep the moisture content of the air in a range which is expedient for drying, it is feasible, for example, to supply ambient air to the drying zone 14 from outside via an opening, for example through the outlet opening for the washware.

The warm and moisture-laden air in the drying zone 14 is then drawn-off from the drying zone 14 via a further opening, for example with the aid of a fan 15. It is advantageous here when the exhaust air stream from the drying zone 14 passes a heat-recovery device 16 in which, for example, a condenser can be provided. The heat-recovery device 16 serves to recover at least some of the thermal energy contained in the exhaust air. This recovered thermal energy can be used, for example, to heat the liquid which is sprayed in the final rinse zones 13.1 and 13.2.

The final rinse zones 13.1, 13.2 can have an associated common fresh water container 23 in order to temporarily store at least a portion of the fresh water which is provided for final rinsing (disinfection final rinsing and post-disinfection final rinsing). The fresh water container 23 is firstly provided with a fresh water connection which can be connected to a fresh water supply system via an actuable fresh water feed valve V1. Secondly, the fresh water container 23 is connected to the intake end of a first final rinse pump 37*a*.

The delivery end of the first final rinse pump 37*a* is connected to the upstream end region of a first line system 40, by means of which first line system fresh water is delivered from the fresh water container 23 to the final rinse nozzles 33*a*, 33*b*, 34*a* and 34*b* when the first final rinse pump 37*a* is operated. Specifically, the first line system 40 connects the delivery end of the first final rinse pump 37*a* to a throughflow heater 17.1 (boiler). In this case, the first line system 40 is formed in such a way that the liquid which is supplied from the first final rinse pump 37*a* to the final rinse nozzles 33*a*, 33*b*, 33*a* and 34*b* first passes the heat-recovery device 16 before reaching the throughflow heater 17.1. In this way, it is possible to use at least some of the thermal energy from the exhaust air which is discharged from the drying zone 14 to heat the liquid which is supplied to the spray nozzles 33*a*, 33*b*, 34*a* and 34*b* by means of the first line system 40. The fresh water which is supplied by means of the first line system 40 is therefore correspondingly heated.

A second line system, what is called the pre-rinse liquid line 42, connects the collection device 22.1, which is in the form of a tank and is associated with the final rinse zone 13.1, to the pre-rinse nozzles 32*a* and 32*b* of the pre-rinse zone 12 by means of a throughflow heater 17.2 (boiler). The temperature of the pre-rinse liquid which is supplied to the pre-rinse nozzles 32*a* and 32*b* can therefore be controlled independently of the temperature of the final rinse liquids which are sprayed in the final rinse zone 13.1 and in the additional final rinse zone 13.2. The final rinse temperatures are preferably less than 80° C. and are preferably below 70° C. in this case.

FIG. 1 further shows that a sensor devices 70 is provided in the above-mentioned final rinse liquid line 41. Furthermore, a sensor device 71 can optionally also be provided in the pre-rinse liquid line 42 according to the illustrated embodiment. The sensor devices 70, 71 are each configured to measure the concentration of disinfectant in the final rinse liquid and, respectively, in the pre-rinse liquid. To this end, the two sensor devices 70, 71 are each connected to a control device 100 which is configured to compare the detected value of the concentration of disinfectant with predefinable concentration values. If there are excessively high deviations of the concentration of disinfectant from the predefinable concentration values, the sensor device 100 can interrupt the dishwashing process or output a warning signal to the operator. The warning signals may be, for example, acoustic signals, which are output by means of the loudspeaker 80, or optical signals, which are output by means of a screen 81.

Although not illustrated in FIG. 1, the control device 100 can also be used to stop the conveying device 2 of the conveyor dishwasher 1 if the concentration of disinfectant in the final rinse liquid line 41 or in the pre-rinse liquid line 42 falls below a required minimum concentration or exceeds a required maximum concentration. Specifically, the control device 100 can be connected to a drive of the conveying device 2 for this purpose. As an alternative or in addition, it is feasible for the control device 100 to be connected to the valve V3 in order to interrupt a supply of fresh water to the final rinse liquid line 41 and therefore the supply of final rinse liquid to the final rinse zone 13.1 in the event of excessively high deviations in the concentration of disinfectant. It is also feasible to control the pre-rinse pump 38*b* by means of the control device 100 in order to interrupt the supply of pre-rinse liquid to the pre-rinse zone as soon as the concentration of disinfectant assumes impermissible values.

The two sensor devices 70, 71 are each arranged directly in the final rinse liquid and, respectively, pre-rinse liquid line 41, 42 according to the embodiment illustrated in FIG. 1. However, as an alternative to this, it is also feasible for said sensor devices to be arranged in a branch line which runs parallel to the final rinse liquid line 41 and, respectively, pre-rinse liquid line 42.

The present invention is not restricted to the exemplary embodiment described above, but rather can be gathered from looking at all the individual features disclosed in said exemplary embodiment together.

The invention claimed is:

1. A conveyor dishwasher for washing washware, wherein the conveyor dishwasher has at least one wash zone with at least one wash nozzle for spraying wash liquid onto the washware, and has at least one final rinse zone with at least one final rinse nozzle for spraying final rinse liquid onto the washware, and wherein a metering device is connected for adding a disinfectant to a final rinse line that feeds the at least one final rinse nozzle so that the disinfectant is added to the final rinse liquid in a metered manner prior to spraying of the final rinse liquid from the at least one final rinse nozzle, characterized in that a sensor device is provided, the sensor device being configured to detect a concentration of disinfectant in the final rinse liquid in the final rinse line prior to spraying of the final rinse liquid from the at least one final rinse nozzle in the final rinse zone, and in that a control device is provided, the control device being configured to compare the value of the concentration of disinfectant which is detected by the sensor device with a predefined concentration value and, in the event the concentration of disinfectant deviates by at least a defined deviation value from the predefined concentration value, to interrupt the dishwashing process or to output a warning signal to an operator.

2. The conveyor dishwasher as claimed in claim 1, wherein the control device is configured in such a way that the defined deviation value can be adjusted.

3. The conveyor dishwasher as claimed in claim 2, wherein the defined deviation value is a first defined deviation value, wherein the control device is configured such that if the concentration of disinfectant which is measured by the sensor device deviates above the predefined concentration value by at least the first defined deviation value, or if the concentration of disinfectant which is measured by the sensor device deviates below the first predefined concentration value by at least a second defined deviation value, the control device interrupts the dishwashing process or outputs the warning signal to an operator, wherein the second defined deviation value is different than the first defined deviation value.

4. The conveyor dishwasher as claimed in claim 2 wherein the conveyor dishwasher has a conveyor apparatus for conveying washware through the at least one wash zone and the at least one final rinse zone, and wherein the control device is configured to stop the conveyor apparatus as soon as the concentration of disinfectant deviates by at least the defined deviation value from the predefined concentration value.

5. The conveyor dishwasher as claimed in claim 2, wherein the control device is configured to interrupt the spraying of wash liquid and/or final rinse liquid as soon as the concentration of disinfectant deviates by at least the defined deviation value from the predefined concentration value.

6. The conveyor dishwasher as claimed in claim 2, wherein the control device is configured to output an optical or acoustic warning signal as soon as the concentration of disinfectant deviates by at least the defined deviation value from the predefined concentration value.

7. The conveyor dishwasher as claimed in claim 6, wherein the control device is configured to output causes for the concentration of disinfectant deviating by at least the defined deviation value from the predefined concentration value, together with the optical or acoustic warning signal.

8. The conveyor dishwasher as claimed in claim 1, wherein the control device is configured to interrupt the dishwashing process or to output a warning signal to an operator as soon as a concentration of disinfectant falls below 50 ppm and/or as soon as a concentration of disinfectant rises above 100 ppm.

9. The conveyor dishwasher as claimed in claim 1, wherein the metered disinfectant contains a chlorine solution.

10. The conveyor dishwasher as claimed in claim 9, wherein the sensor device is configured to detect free chlorine radicals.

11. The conveyor dishwasher as claimed in claim 10, wherein the sensor device is configured to detect free chlorine radicals in a concentration range of between 0 and 200 ppm.

12. The conveyor dishwasher as claimed in claim 10, wherein the sensor device is configured to detect free chlorine radicals with a measurement resolution of no worse than ±5 ppm.

13. The conveyor dishwasher as claimed in claim 1, wherein the sensor device is configured to detect the concentration of disinfectant continuously or at predefinable time intervals.

14. The conveyor dishwasher as claimed in claim 1, wherein the liquid which is sprayed in the at least one wash zone has a temperature of less than 60° C., and/or wherein the liquid which is sprayed in the at least one final rinse zone has a temperature of less than 80° C.

15. The conveyor dishwasher as claimed in claim 1, wherein the conveyor dishwasher further has at least one pre-rinse zone with at least one pre-rinse nozzle, which pre-rinse zone is arranged upstream of the final rinse zone, wherein a metering device is connected for adding a disinfectant to a pre-rinse line that feeds the at least one pre-rinse nozzle so that disinfectant is added to the pre-rinse liquid in a metered manner prior to spraying of the pr-rinse liquid from the at least one pre-rinse nozzle, and wherein the sensor device is further configured to detect the concentration of disinfectant in the pre-rinse liquid in the pre-rinse line prior to spraying of the pre-rinse liquid from the at least one pre-rinse nozzle in the pre-rinse zone.

16. The conveyor dishwasher as claimed in claim 15, wherein at least a portion of the final rinse liquid which is sprayed in the final rinse zone is reused as pre-rinse liquid.

17. A conveyor dishwasher for washing washware, wherein the conveyor dishwasher has at least one wash zone with at least one wash nozzle for spraying wash liquid onto the washware, and has at least one final rinse zone with at least one final rinse nozzle for spraying final rinse liquid onto the washware, and wherein a metering device is connected for adding a disinfectant to final rinse liquid that is fed to the at least one final rinse nozzle so that the disinfectant is added to the final rinse liquid in a metered manner prior to spraying of the final rinse liquid from the at least one final rinse nozzle, wherein a sensor device is configured to detect a concentration of disinfectant in the final rinse liquid prior to spraying of the final rinse liquid from the at least one final rinse nozzle in the final rinse zone, and a control device is configured to compare the value of the concentration of disinfectant which is detected by the sensor device with a predefined concentration value and, in the event the concentration of disinfectant deviates by at least a first defined deviation value above the predefined concentration value or by at least a second defined deviation value below the predefined concentration value, to interrupt the dishwashing process or to output a warning signal to an operator, wherein the second defined deviation value is different than the first defined deviation value.

* * * * *